US011257640B2

(12) United States Patent
Chen et al.

(10) Patent No.: US 11,257,640 B2
(45) Date of Patent: Feb. 22, 2022

(54) ELECTRONIC DEVICE AND METHOD OF MANUFACTURING THE SAME

(71) Applicant: ASUSTeK COMPUTER INC., Taipei (TW)

(72) Inventors: Yu-Kuang Chen, Taipei (TW); Chao-Shun Wang, Taipei (TW); Chien-Yi Huang, Taipei (TW)

(73) Assignee: ASUSTEK COMPUTER INC., Taipei (TW)

( * ) Notice: Subject to any disclaimer, the term of this patent is extended or adjusted under 35 U.S.C. 154(b) by 0 days.

(21) Appl. No.: 17/069,976

(22) Filed: Oct. 14, 2020

(65) Prior Publication Data

US 2021/0118633 A1 Apr. 22, 2021

(30) Foreign Application Priority Data

Oct. 21, 2019 (TW) ..... 108137934

(51) Int. Cl.
*H01H 13/83* (2006.01)
*H01H 13/88* (2006.01)

(52) U.S. Cl.
CPC ..... *H01H 13/83* (2013.01); *H01H 13/88* (2013.01); *H01H 2219/054* (2013.01); *H01H 2233/07* (2013.01)

(58) Field of Classification Search
CPC .. H01H 13/83; H01H 13/88; H01H 2219/054; H01H 2233/07
USPC ..... 200/5 A, 314
See application file for complete search history.

(56) References Cited

U.S. PATENT DOCUMENTS

2012/0298491 A1* 11/2012 Ozias ..... G06F 1/1662 200/314
2013/0087440 A1* 4/2013 Huang ..... H01H 13/83 200/314

FOREIGN PATENT DOCUMENTS

| | | | |
|---|---|---|---|
| CN | 103175022 | A | 6/2013 |
| CN | 104598038 | A | 5/2015 |
| CN | 106384689 | A | 2/2017 |
| CN | 206754939 | U | 12/2017 |

* cited by examiner

*Primary Examiner* — Edwin A. Leon
*Assistant Examiner* — Iman Malakooti
(74) *Attorney, Agent, or Firm* — McClure, Qualey & Rodack, LLP

(57) ABSTRACT

An electronic device is provided here, which includes a casing, a keycap and a keyboard backlight module. The casing has a first opening. The keycap is disposed corresponding to the first opening, and a gap is formed between the keycap and a periphery of the first opening. The keyboard backlight module includes a shielding layer, the shielding layer includes a light transmission area corresponding to the first opening and a light block portion, and the light block portion is located in the light transmission area and covers a region where at least one light path passes through the gap and intersects the light transmission area through.

6 Claims, 8 Drawing Sheets

700

ELECTRONIC DEVICE AND METHOD OF MANUFACTURING THE SAME

CROSS-REFERENCE TO RELATED APPLICATION

This application claims the priority benefit of Taiwan applications serial No. 108137934, filed on Oct. 21, 2019. The entirety of the above-mentioned patent application is hereby incorporated by reference herein and made a part of specification.

BACKGROUND OF THE INVENTION

Field of the Invention

The invention relates to an electronic device and method of manufacturing thereof.

Description of the Related Art

Backlit keyboards are equipped with a light source to illuminate the keyboard keys, so that the user can clearly recognize the letters and symbols on the keys in a low-light environment. However, the backlight leaks from the gap between the keycap and the keyboard casing (such as the C-part of a laptop) which results in recognize difficulty of the letters and symbols, and further affects users' operation accuracy and speed.

BRIEF SUMMARY OF THE INVENTION

According to the first aspect, an electronic device is provided. The electronic device includes a casing, a keycap and a keyboard backlight module. The casing has a first opening. The keycap is disposed corresponding to the first opening, and a gap is formed between the keycap and a periphery of the first opening. The keyboard backlight module includes a shielding layer, the shielding layer includes a light transmission area corresponding to the first opening and a light block portion, and the light block portion is located in the light transmission area and covers a region where at least one light path passes through the gap and intersects the light transmission area through.

According to the second aspect, a manufacturing method of an electronic device is also provided. The manufacturing method of an electronic device includes following steps: providing a casing, a keycap, and a keyboard backlight module, the keyboard backlight module includes a shielding layer; forming a first opening on the casing; positioning the keycap within the first opening, so that a gap is formed between the keycap and a periphery of the first opening; forming a light transmission area corresponding to the first opening on the shielding layer; selecting an area intersecting at least one light path passing through the gap in the light transmission area; and disposing a light block portion in the area.

In summary, the electronic device includes the keyboard backlight module, and the shielding layer on the top of the keyboard backlight module includes the light transmission area, to provide the keyboard backlight module to illuminate the keycap. The light block portion is disposed in the light transmission area to block the light that may leak from the gap between the keycap and the casing.

These and other features, aspects and advantages of the present invention will become better understood with regard to the following description, appended claims, and accompanying drawings.

DETAILED DESCRIPTION OF THE EMBODIMENTS

Figure 1:
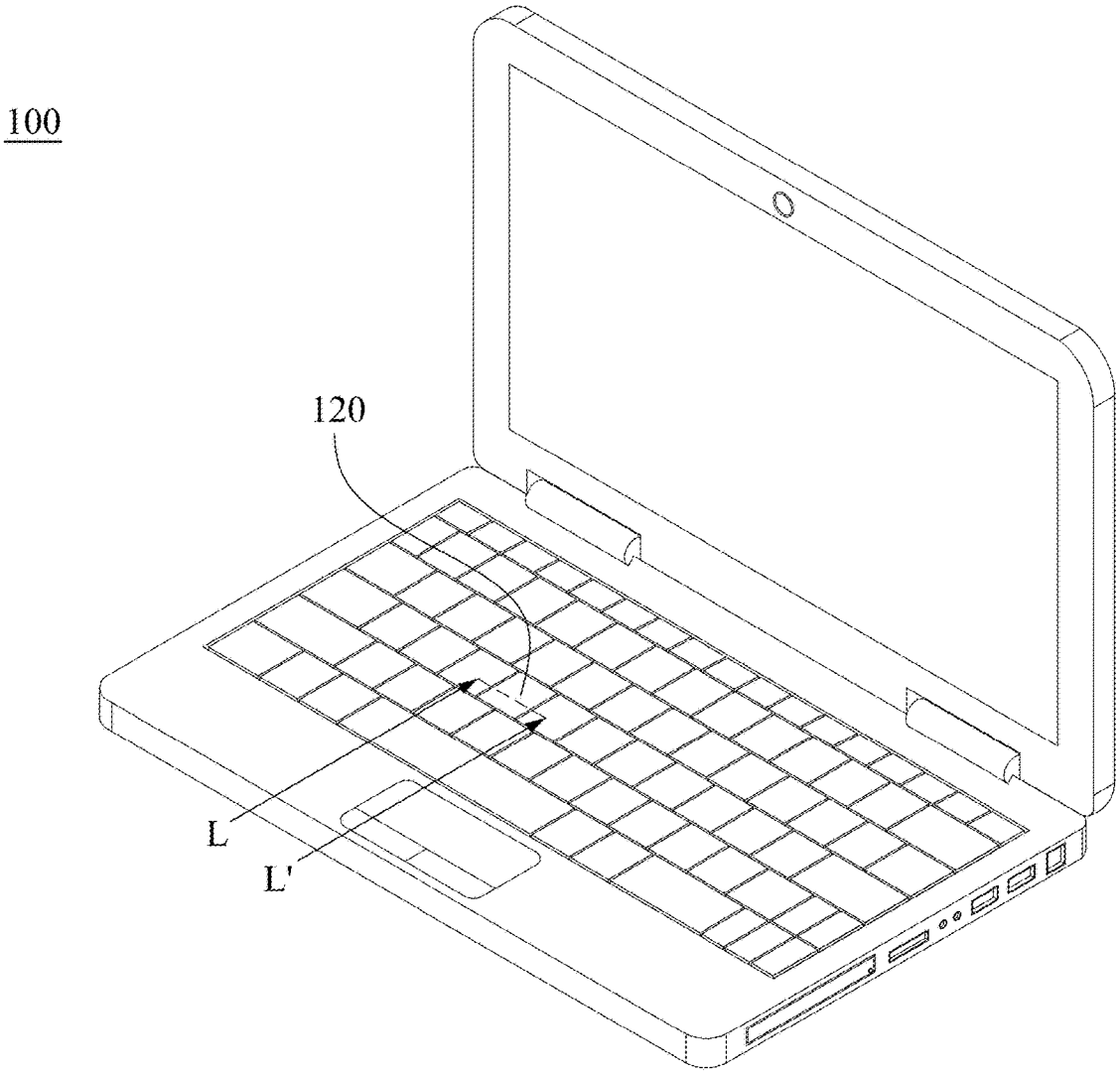
FIG. 1 is a perspective view showing an electronic device according to an embodiment.

To make the description more detailed and complete, reference may be made to the accompanying drawings and various embodiments described below. The elements in the drawings are not drawn to scale and are provided only to illustrate the disclosure. Many practical details are described below to provide a comprehensive understanding of this disclosure. However, those of ordinary skill in the relevant arts should understand that this disclosure can be implemented without one or more practical details. Therefore, these details are not to limit this disclosure.

Figure 2:
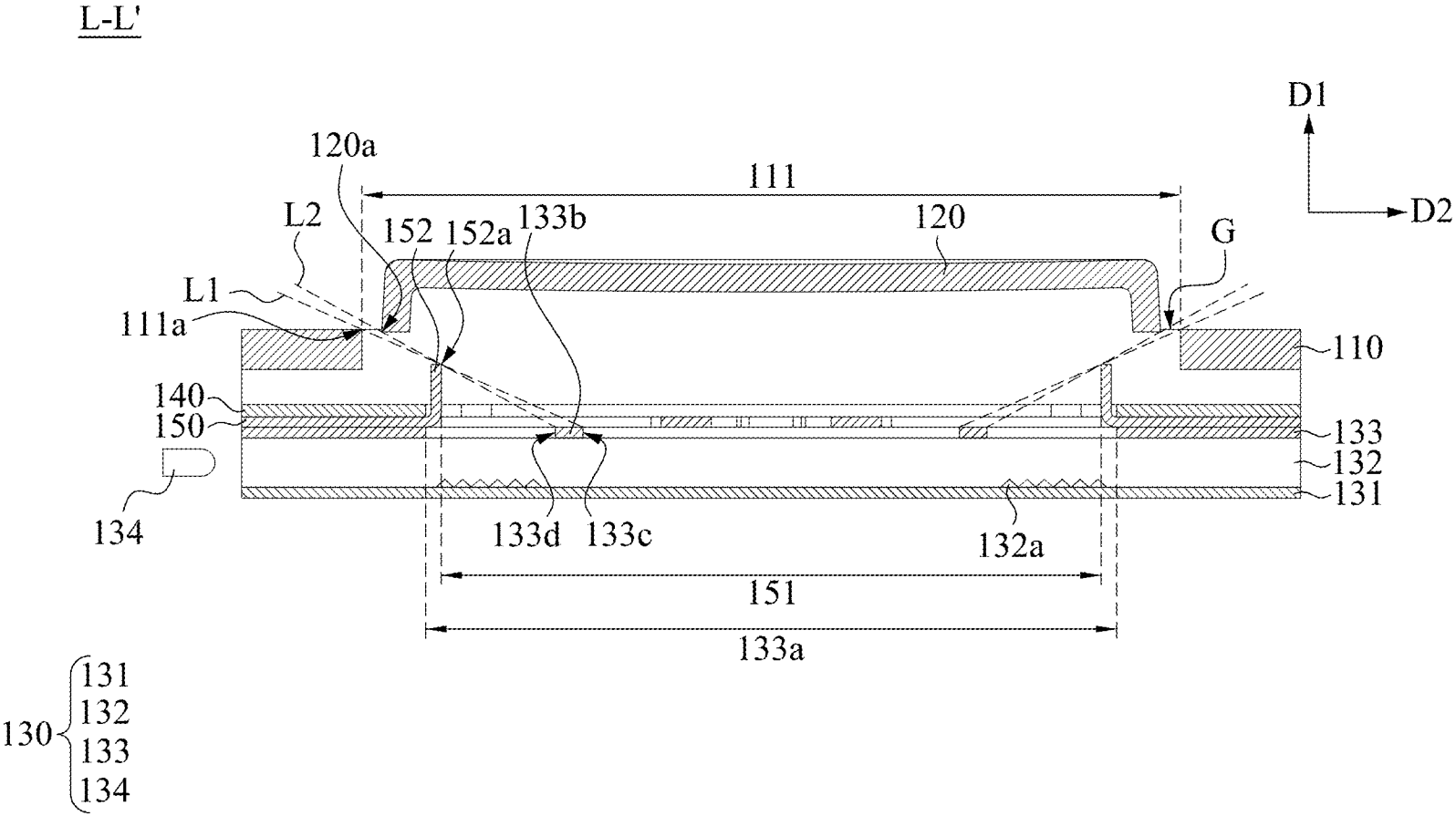
FIG. 2 is a partially enlarged cross-sectional view of the electronic device along line L-L' shown in FIG. 1.

Please refer to FIG. 1 and FIG. 2. FIG. 1 is a perspective view showing an electronic device 100 according to an embodiment, and FIG. 2 is a partially enlarged cross-sectional view of the electronic device 100 along line L-L' shown in FIG. 1. The electronic device 100 (such as a notebook computer) includes a casing 110, a keycap 120 and a keyboard backlight module 130. The casing 110 has a first opening 111. The keycap 120 is disposed corresponding to the first opening 111, and is configured to move in and out of the first opening 111. In order for the keycap 120 moving up and down without being hindered by the casing 110, the cross section of the first opening 111 is larger than the cross section of the keycap 120, so that a gap G is formed between the keycap 120 and a periphery 111*a* of the first opening 111.

As shown in FIG. 2, the keyboard backlight module 130 is located on a side of the casing 110 away from the keycap 120, and provides light to illuminate the keycap 120. Specifically, the light provided by the keyboard backlight module 130 passes through the light transmission letters and/or light transmission symbols (not shown) on the keycap 120 to help users recognize the letters and/or symbols in a low-light environment. The keyboard backlight module 130 is an edge-lit backlight module, which includes a reflecting sheet 131, a light guide plate 132, a shielding layer 133, and a light emitting element 134. The reflecting sheet 131, the light guide plate 132, the shielding layer 133 are stacked in sequence along the normal direction D1 of an outer surface of the casing 110. The light emitting element 134 is located on one side of the light guide plate 132 and is configured to emit the light toward the light guide plate 132 along a direction D2 perpendicular to the direction D1. In some embodiments, the light emitting element 134 is an LED lamp.

In an embodiment, the reflecting sheet 131 reflects the light emitted by the light emitting element 134, that is, the light totally reflected in the light guide plate 132. The shielding layer 133 blocks a part of the light emitted by the light emitting element 134. The shielding layer 133 includes a light transmission area 133*a* and the light transmission area 133*a* corresponds to the first opening 111 (that is, the vertical projection of the light transmission area 133*a* on the reflecting sheet 131 overlaps with the vertical projection of the first opening 111 on the reflecting sheet 131), and passes a part of the light emitted by the light emitting element 134. The light guide plate 132 includes a light guide microstructure 132*a*, which is distributed on a side of the light guide plate 132 facing the reflecting sheet 131. The vertical projection of the light guide microstructure 132*a* on the shielding layer 133 (that is, the projection along the direction D1) is in the light transmission area 133*a*. In an embodiment, the light guide microstructure 132*a* destroys the total reflection of the light transmitted in the light guide plate 132, so that the light changes the direction and radiates outward through the light transmission area 133*a*. In some embodiments, the light guide plate 132 includes polypropylene (PP). In some embodiments, the light guide microstructure 132*a* is formed on the bottom of the light guide plate 132 by imprinting or ink coating.

As the light guide microstructure 132*a* cannot accurately control the light to irradiate the keycap 120 completely, part of the light may leak out from the gap G to lead to a halo phenomenon. To solve this the halo phenomenon problem, as shown in FIG. 2, the shielding layer 133 also includes a light block portion 133*b* located in the light transmission area 133*a*, and covers the region where at least one light path passes through the gap G and intersects the light transmission area 133*a*, thereby blocking the light leakage path. In some embodiments, the shielding layer 133 includes biaxial-oriented polyethylene terephthalate (BoPET, commonly named mylar). The shielding layer 133 includes any suitable black material to provide a shading effect.

In some embodiments, the electronic device 100 further includes a film circuit layer 140 and a bottom plate 150 between the casing 110 and the keyboard backlight module 130. The bottom plate 150 is located on a side of the film circuit layer 140 facing away from the casing 110, to load the film circuit layer 140. In some embodiments, the bottom plate 150 includes metallic materials. The electronic device 100 further includes a scissor structure (not shown) connected between the keycap 120 and the bottom plate 150, the scissor structure guides the keycap 120 to move up and down, and the film circuit layer 140 provides a trigger signal when the keycap 120 is pressed.

As mentioned above, the bottom plate 150 has a second opening 151 and a blocking wall 152. The vertical projection of the second opening 151 on the reflecting sheet 131 overlaps with the vertical projection of the first opening 111 on the reflecting sheet 131, and the second opening 151 is located between the first opening 111 and the light transmission area 133*a*. The light emitting element 134 passes through the light transmission area 133*a*, the second opening 151 and the first opening 111 in sequence after leaving the light guide plate 132. The blocking wall 152 at least partially surrounds the second opening 151, and the blocking wall 152 extends toward the keycap 120 and passes through the film circuit layer 140. In an embodiment, the blocking wall 152 blocks light leaking through the gap G.

As shown in FIG. 2, in some embodiments, the region of the light transmission area 133*a* covered by the light block portion 133*b* intersects the first light path L1. The first light path L1 includes a straight line through the periphery 111*a* of the first opening 111 and the top end 152*a* of the blocking wall 152. In some embodiments, the region of the light transmission area 133*a* covered by the light block portion 133*b* intersects the second light path L2. The second light path L2 is a straight line through the bottom 120*a* of the keycap 120 (when the keycap 120 is at its highest position) and the top end 152*a* of the blocking wall 152.

Figure 3:
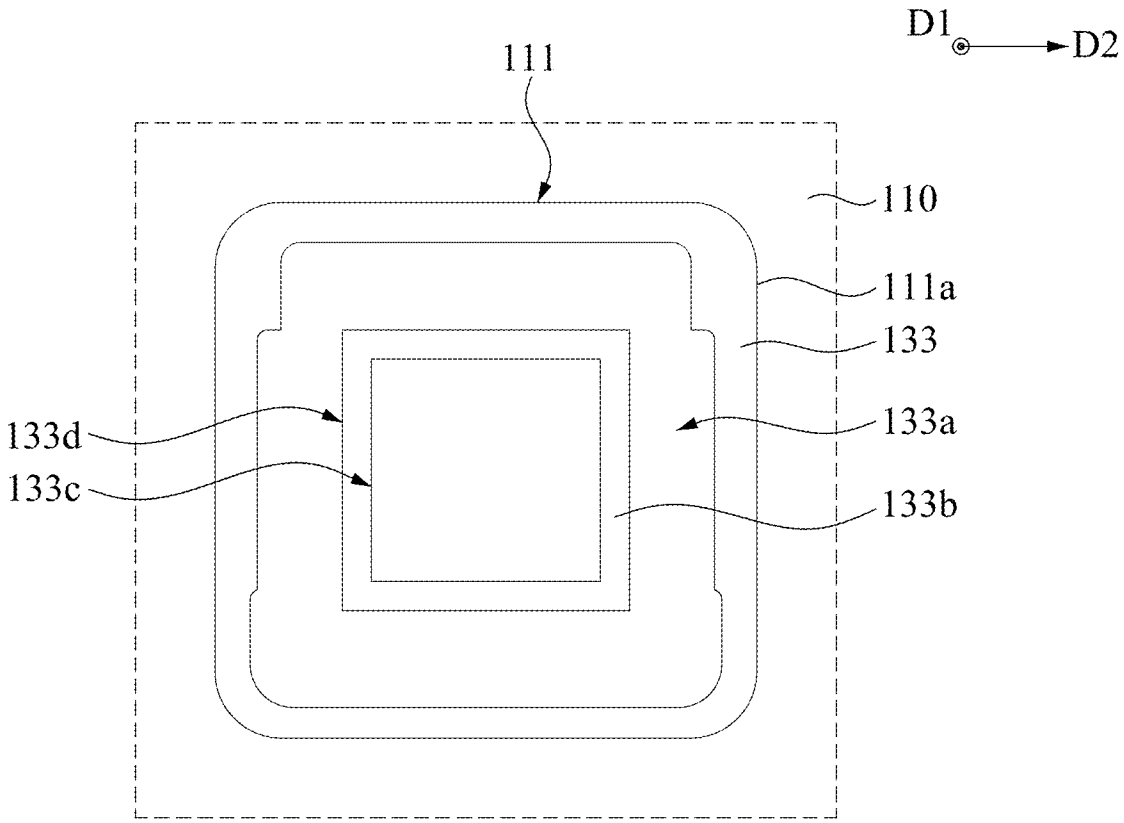
FIG. 3 is a top view showing some components of the electronic device shown in FIG. 2.

Please also refer to FIG. 3, which is a top view showing some components of the electronic device 100 in FIG. 2. In some embodiments, the light block portion 133*b* covers the region where the first light path L1 intersects the light transmission area 133*a* and the region where the second light path L2 intersects the light transmission area 133*a*. In these embodiments, as shown in FIG. 3, the light block portion 133*b* is ring-shaped. The light block portion 133*b* has an inner edge 133*c* and an outer edge 133*d*. As shown in FIG. 2, the inner edge 133*c* of the light block portion 133*b* intersects the first light path L1. In other words, the inner edge 133*c* of the light block portion 133*b*, the periphery 111*a* of the first opening 111, and the top end 152*a* of the blocking wall 152 are collinear. The outer edge 133*d* of the light block portion 133*b* intersects the second light path L2. In other words, the outer edge 133*d* of the light block portion 133*b*, the bottom 120*a* of the keycap 120, and the top end 152*a* of the blocking wall 152 are collinear.

It should be noted that the first light path L1 and the second light path L2 are possible light leakage paths when no the light block portion 133*b* exists. In fact, when the light block portion 133*b* exists, light is blocked by the light block portion 133*b* and does not leak out from the gap G along the first light path L1 and the second light path L2.

As shown in FIG. 2, in some embodiments, the vertical projection of the periphery 111*a* of the first opening 111 on the shielding layer 133 surrounds the light transmission area 133*a*. In other words, on the direction D2, the light transmission area 133*a* is retracted relative to the first opening 111. In some embodiments, on the direction D2, the bottom 120*a* of the keycap 120 is located between the blocking wall 152 and the periphery 111*a* of the first opening 111. In some embodiments, the vertical projection of the light guide microstructure 132*a* on the shielding layer 133 is within the light transmission area 133*a* but does not overlap the light block portion 133*b*. Under the above configuration, the problem of light leakage is solved, and the keycap 120 receives sufficient light.

Figure 4:
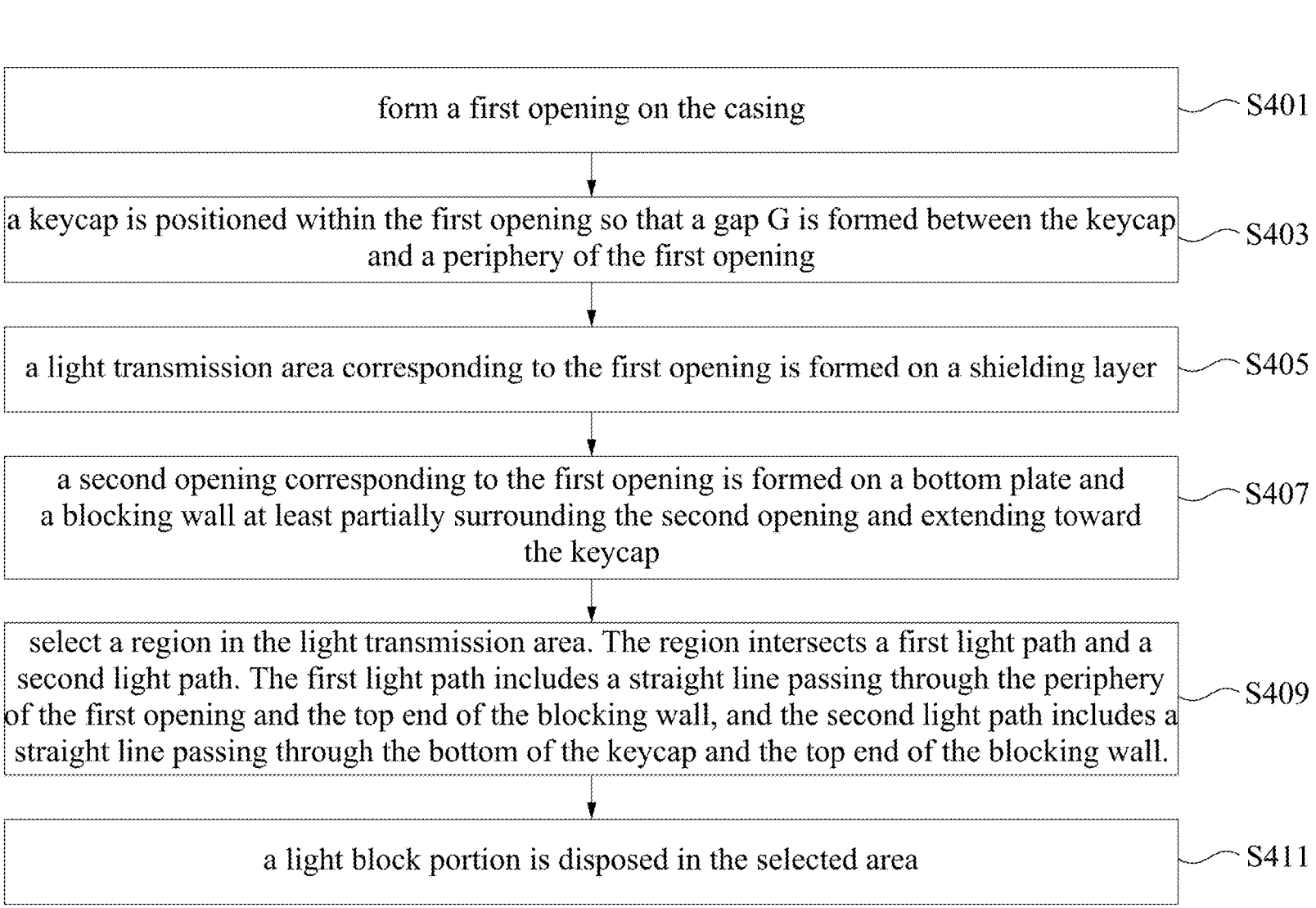
FIG. 4 is a flowchart showing the manufacturing method of an electronic device according to an embodiment.

Please also refer to FIG. 4, which is a flowchart illustrating a method 400 of manufacturing the electronic device according to an embodiment. The electronic device manufacturing method 400 includes steps S401 to S411.

First, in step S401, form a first opening 111 on the casing 110. Next, in step S403, a keycap 120 is positioned within the first opening 111 so that a gap G is formed between the keycap 120 and a periphery 111*a* of the first opening 111. Next, in step S405, a light transmission area 133*a* corresponding to the first opening 111 is formed on a shielding layer 133 (that is, the vertical projection of the light transmission area 133*a* on the reflecting sheet 131 overlaps with the vertical projection of the first opening 111 on the reflecting sheet 131).

Next, in step S407, a second opening 151 corresponding to the first opening 111 is formed on a bottom plate 150 (that is, the vertical projection of the second opening 151 on the reflecting sheet 131 overlaps with the vertical projection of the first opening 111 on the reflecting sheet 131) and a blocking wall 152 partially surrounds the second opening 151 and extends toward the keycap 120. In some embodiments, the second opening 151 stamping, after stamping, a metal sheet is retained at the edge of the second opening 151, and then bent to form the blocking wall 152.

Then, in step S409, select a region in the light transmission area 133*a*. The region intersects the first light path L1 and the second light path L2. The first light path L1 includes a straight line passing through the periphery 111*a* of the first opening 111 and the top end 152*a* of the blocking wall 152, and the second light path L2 includes a straight line passing through the bottom 120*a* of the keycap 120 and the top end 152*a* of the blocking wall 152. In an embodiment, the selected region is a circular region shown in FIG. 3.

Finally, in step S411, the light block portion 133*b* is disposed in the selected area. In an embodiment, as shown in FIG. 3, the light block portion 133*b* has a ring shape, the inner edge 133*c* of the light block portion 133*b* intersects the first light path L1, and the outer edge 133*d* of the light block portion 133*b* intersects the second light path L2.

Figure 5:
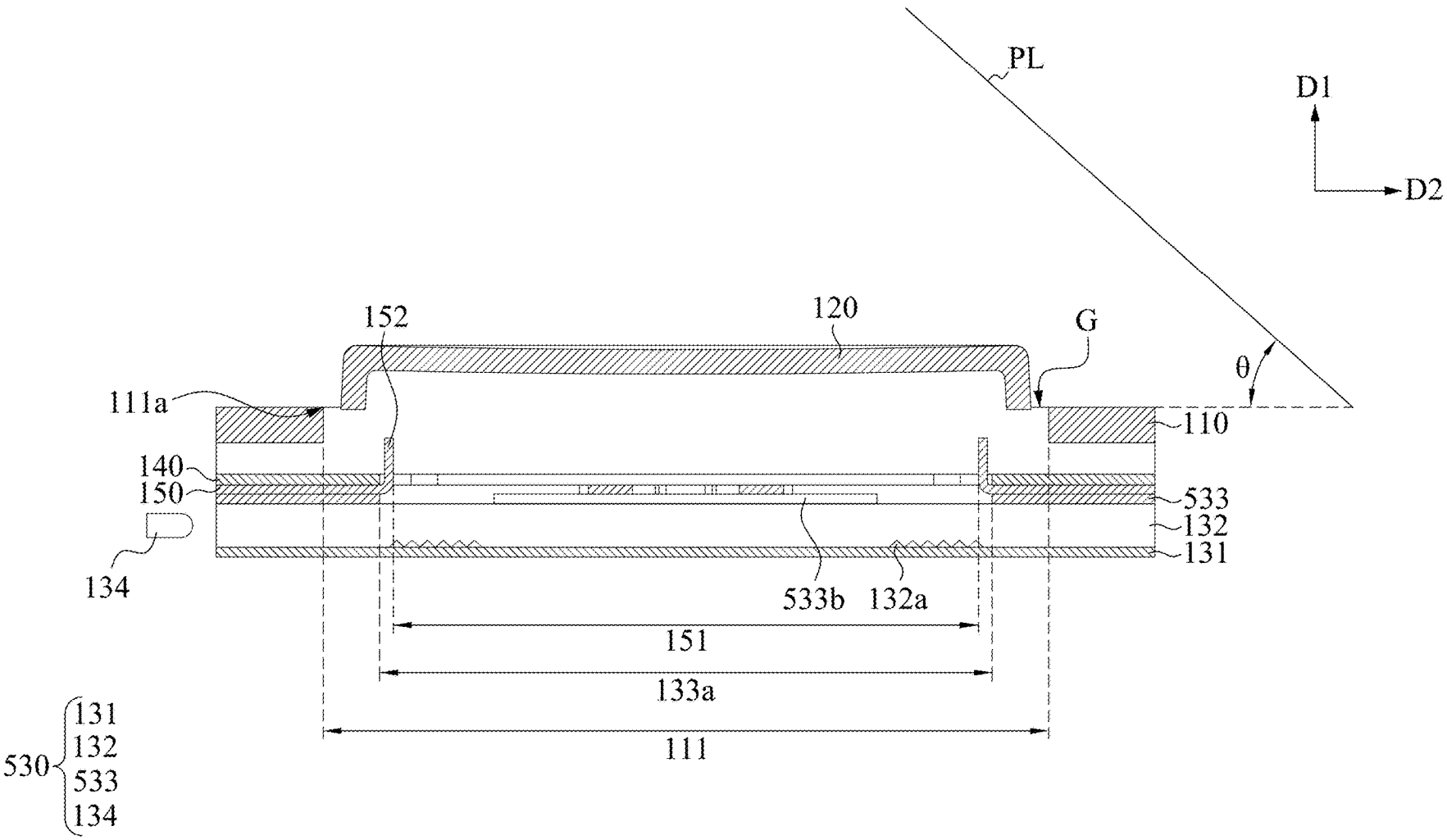
FIG. 5 is a partially enlarged cross-sectional view showing the electronic device according to another embodiment.
Figure 6:
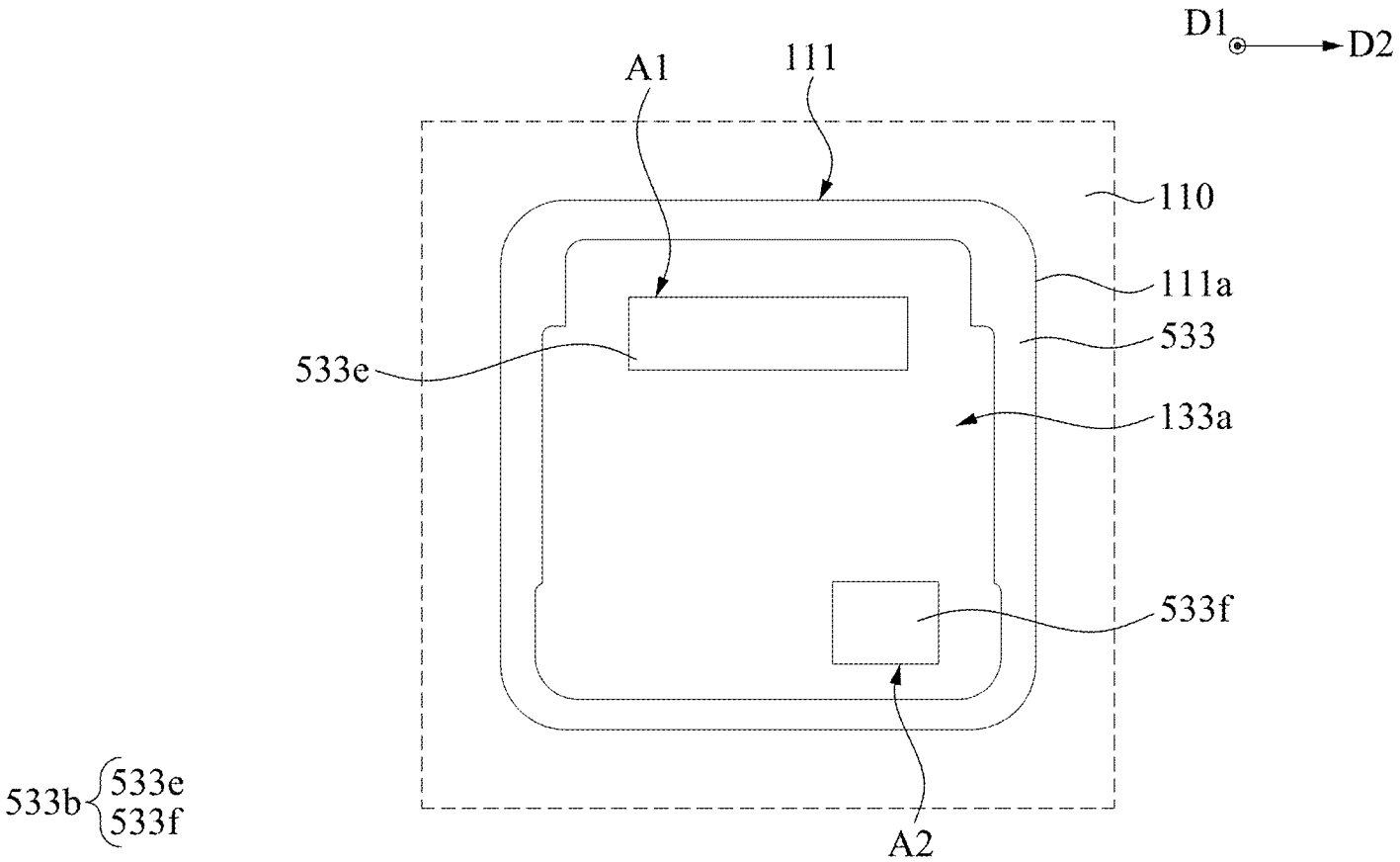
FIG. 6 is a top view showing some components of the electronic device shown in FIG. 5.

Please refer to FIG. 5 and FIG. 6. FIG. 5 is a partially enlarged cross-sectional view showing the electronic device according to another embodiment. FIG. 6 is a top view showing some components of the electronic device shown in FIG. 5. In this embodiment, the configuration of the light block portion 533*b* of the shielding layer 533 is determined by optical simulation. Specifically, the light block portion 533*b* covers the region where at least a third light path (not shown) passing through the gap G intersects the light transmission area 133*a*, the third light path passes through at least one bright area of the observation datum plane PL. The bright area is formed on the observation datum plane PL by a plurality of light rays emitted by the keyboard backlight module 530, the plurality of light rays passes through the light transmission area 133*a* without the light block portion 533*b* and the first opening 111. In other words, the electronic device blocks halo formed by the light rays emitted from the keyboard backlight module 530 at specific observation angle by the light block portion 533*b* of the shielding layer 533, thereby solving the halo problem.

The electronic device provided in this disclosure blocks light leaked from the gap G due to reflection, refraction and other optical behaviors caused by the keycap 120, the film circuit layer 140, the bottom plate 150, scissor structure or other structures in the keyboard of the electronic device. Ideally, the observation datum plane PL should be as close as possible to the user's perspective in order to more accurately present the situation observed by the user. In some embodiments, the angle θ between the observation datum plane PL and the outer surface of the casing 110 is substantially 45 degrees.

Figure 7:
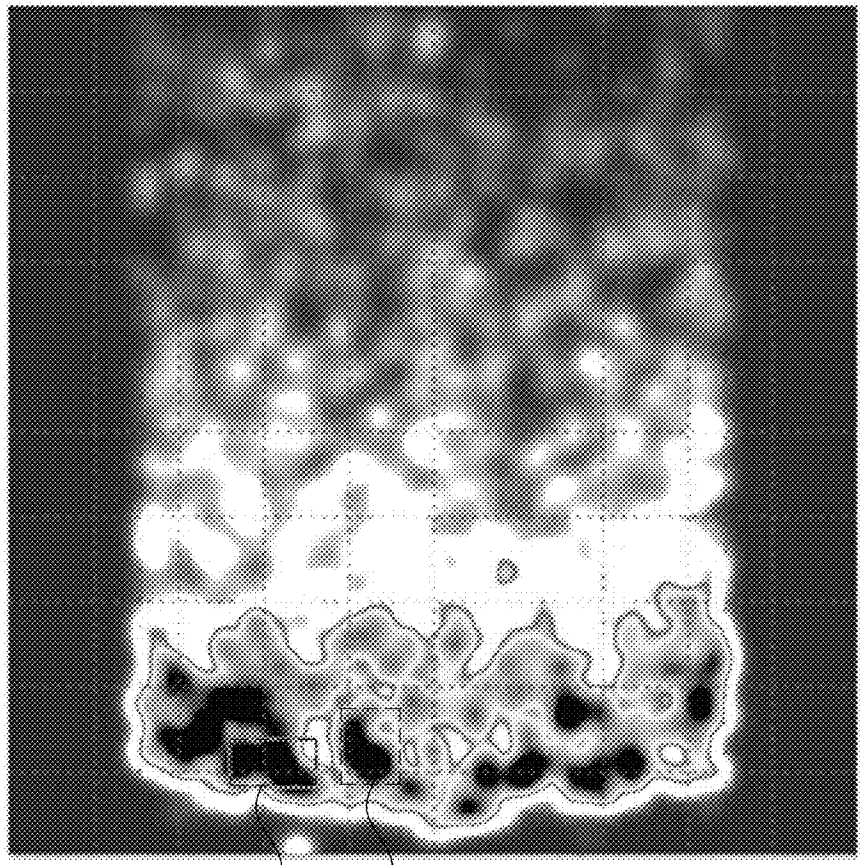
FIG. 7 shows a luminous flux distribution diagram corresponding to the observation datum plane shown in FIG. 5.
Figure 8:
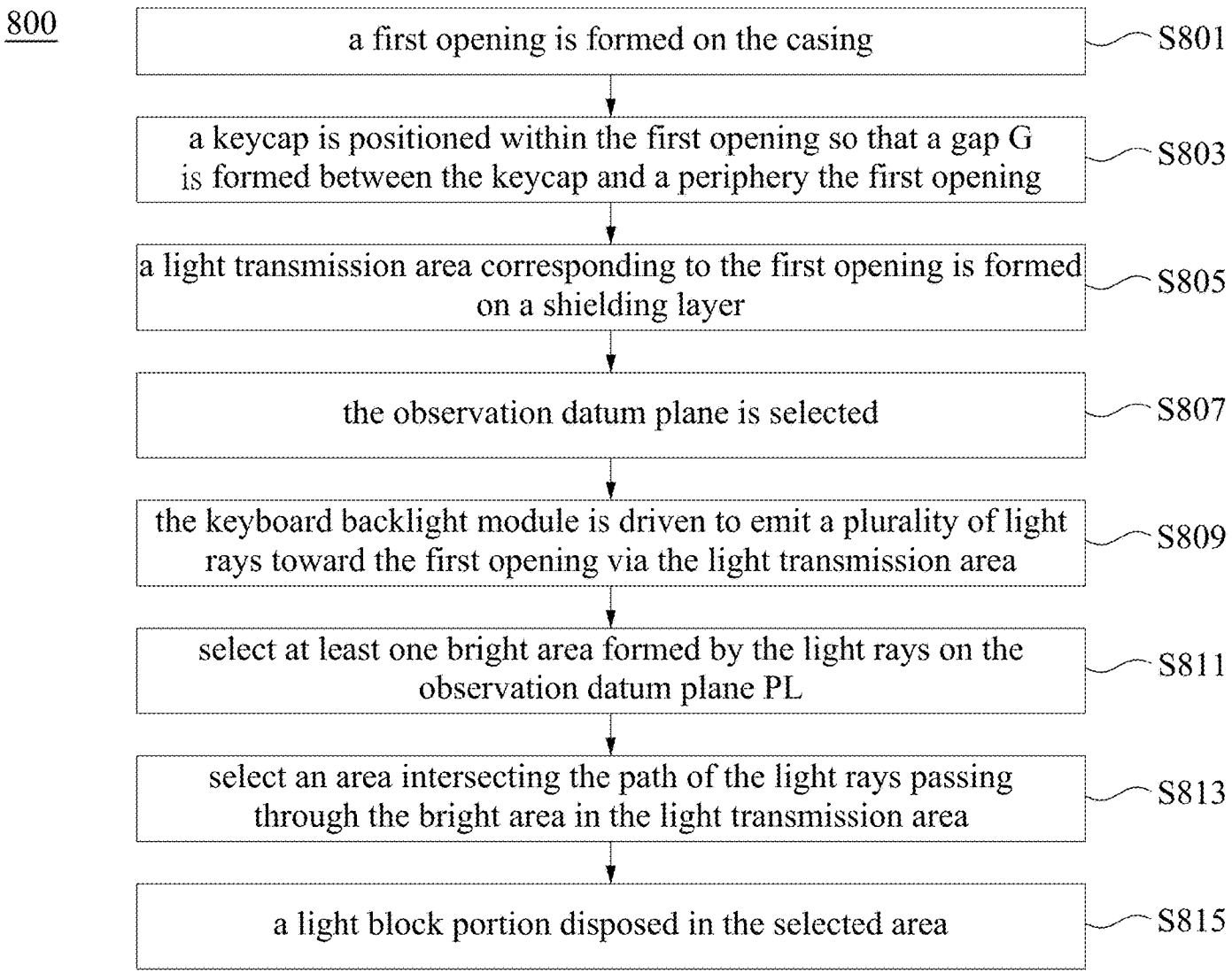
FIG. 8 is a flowchart showing the manufacturing method of an electronic device according to another embodiment.

Please refer to FIG. 7 and FIG. 8. FIG. 7 is a flowchart illustrating the luminous flux distribution diagram 700 corresponding to the observation datum plane PL shown in FIG. 5, and FIG. 8 is a flowchart illustrating the electronic device manufacturing method 800 according to another embodiment of the present disclosure. The electronic device manufacturing method 800 is used to manufacture the electronic device shown in FIG. 5 and FIG. 6, which includes step S801 and step S815.

First, in step S801, a first opening 111 is formed in the casing 110. Next, in step S803, a keycap 120 is positioned within the first opening 111, so that a gap G is formed between the keycap 120 and the periphery 111*a* of the first opening 111. Next, in step S805, a light transmission area 133*a* corresponding to the first opening 111 is formed on a shielding layer 533 (that is, the vertical projection of the light transmission area 133*a* on the reflecting sheet 131 overlaps the first opening 111 on the reflecting sheet 131 of the vertical projections).

Next, in step S807, an observation datum plane PL is selected. In an embodiment, select a plane with a 45 degree relative to the outer surface of the casing 110 as the observation datum plane PL.

Next, in step S809, a keyboard backlight module 530 is driven to emit toward the first opening 111 via the light transmission area 133*a*. This step is to analyze a possible light transmission path by determining the structural configuration (shape, position, material, optical characteristics, etc.) of the electronic device's keyboard except the light block portion 533*b*.

Next, in step S811, select at least one bright area formed by the light rays on the observation datum plane PL. As shown in FIG. 7, in some embodiments, this step includes: establishing the luminous flux distribution diagram 700 generated by the light rays emitted by the keyboard backlight module 530 on the observation datum plane PL; and selecting at least one bright area based on the luminous flux distribution diagram 700. In the luminous flux distribution diagram 700, the color from light to dark represents the light flux received by the observation datum plane PL from weak to strong. In an embodiment, the bright area selected is bright areas 701, 702. In some embodiments, the bright area is the area whose luminous flux is higher than a threshold.

Next, in step S813, select an area intersecting the path of the light rays passing through the bright area in the light transmission area 133*a*. In an embodiment, as shown in FIG. 6 and FIG. 7, the paths of the light rays passing through the bright area 701, 702 intersects the light transmission area 133*a* in the areas A1, A2. In other words, the area A1 and A2 are positions where the light rays passing through the bright area 701 and 702 and the light transmission area 133*a*.

Finally, in step S815, a light block portion 533*b* is disposed in the selected area. In an embodiment, as shown in FIG. 6, a first sub-light blocking section 533*e* and a second sub-light blocking section 533*f* are disposed in the area A1 and A2, respectively, to block light leaked form the area A1, A2.

In summary, the electronic device includes the keyboard backlight module, and the shielding layer on the top of the keyboard backlight module includes the light transmission area, to provide the keyboard backlight module illuminate the keycap. The light block portion is disposed in the light transmission area to block the light leaked from the gap between the keycap and the casing.

Although the present invention has been described in considerable detail with reference to certain preferred embodiments thereof, the disclosure is not for limiting the scope. Persons having ordinary skill in the art may make various modifications and changes without departing from the scope. Therefore, the scope of the appended claims should not be limited to the description of the preferred embodiments described above.

What is claimed is:

1. An electronic device, comprising:

a casing, having a first opening;

a keycap, disposed corresponding to the first opening, and a gap is formed between the keycap and a periphery of the first opening;

a bottom plate disposed beneath the casing, the bottom plate comprising a second opening corresponding to the first opening and a blocking wall surrounding the second opening;

a film circuit layer disposed over the bottom plate, wherein the blocking wall is taller than a portion of the bottom plate covered by the film circuit layer, and the blocking wall passes through the film circuit layer; and a keyboard backlight module, including a shielding layer, the shielding layer includes a light transmission area corresponding to the first opening and a light block portion, the light block portion is located in the light transmission area and covers a region where at least one light path passes through the gap and intersects the light transmission area through;

wherein the at least one light path includes at least one of a first straight line and a second straight line, wherein the first straight line passes through the periphery of the first opening and a top end of the blocking wall, and the second straight line passes through a bottom of the keycap and the top end of the blocking wall.

2. The electronic device according to claim 1, wherein;

the bottom plate, located between the casing and the keyboard backlight module, and the blocking wall extends toward the keycap.

3. The electronic device according to claim 1, wherein the light path passes through at least one bright area of an observation datum plane, the bright area is formed on the observation datum plane by a plurality of light rays emitted by the keyboard backlight module, the plurality of light rays passes through the light transmission area without the light block portion and the first opening.

4. A manufacturing method of an electronic device, comprising:

providing a casing, a keycap, and a keyboard backlight module, the keyboard backlight module includes a shielding layer;

forming a first opening on the casing;

positioning the keycap within the first opening and forming a gap between the keycap and a periphery of the first opening;

providing a bottom plate beneath the casing;

providing a film circuit layer over the bottom plate;

forming a second opening corresponding to the first opening on the bottom plate;

forming a blocking wall on the bottom plate, wherein the blocking wall surrounds the second opening, and the blocking wall is taller than a portion of the bottom plate covered by the film circuit layer and passes through the film circuit layer;

forming a light transmission area corresponding to the first opening on the shielding layer;

selecting an area intersecting at least one light path passing through the gap in the light transmission area, wherein the at least one light path includes at least one of a first straight line and a second straight line, wherein the first straight line passes through the periphery of the first opening and a top end of the blocking wall, and the second straight line passes through a bottom of the keycap and the top end of the blocking wall; and disposing a light block portion in the area of the light transmission area.

5. The manufacturing method of the electronic device according to claim 4, wherein:

the bottom plate is between the casing and the keyboard backlight module; and the blocking wall extends towards the keycap.

6. A manufacturing method of an electronic device, comprising:

providing a casing, a keycap, and a keyboard backlight module, the keyboard backlight module includes a shielding layer;

forming a first opening on the casing;

positioning the keycap within the first opening and forming a gap between the keycap and a periphery of the first opening;

forming a light transmission area corresponding to the first opening on the shielding layer;

selecting an observation datum plane at an angle to an outer surface of the casing;

conducting a simulation of the keyboard backlight module emitting a plurality of light rays toward the first opening through the light transmission area;

selecting at least one bright area formed by the light rays on the observation datum plane, wherein the at least one bright area has luminous flux higher than a threshold;

selecting an area of the light transmission area that is intersected by paths of the light rays forming the at least one bright area; and disposing a light block portion in the area of the light transmission area.

* * * * *